United States Patent [19]

Watson et al.

[11] 4,060,381

[45] Nov. 29, 1977

[54] SHIELD FOR PYROMETRIC CONES USED IN CERAMIC FIRING KILNS

[75] Inventors: John C. Watson; John D. Watson; Gerald K. Watson, all of Caseville, Mich.

[73] Assignee: Evenheat Kiln, Inc., Caseville, Mich.

[21] Appl. No.: 682,193

[22] Filed: May 3, 1976

[51] Int. Cl.[2] ..... F27D 1/10

[52] U.S. Cl. ..... 432/247; 73/358; 432/249

[58] Field of Search ..... 432/247, 249, 250; 73/358

[56] References Cited

U.S. PATENT DOCUMENTS

| | | | |
|---|---|---|---|
| 1,443,786 | 1/1923 | Dolph | 73/358 X |
| 1,824,747 | 9/1931 | DeCoriolis | 432/249 |
| 2,094,293 | 9/1937 | Dupont | 73/358 X |
| 2,837,326 | 6/1958 | Muth | 432/249 |
| 3,181,847 | 5/1965 | Hauth, Jr. et al. | 432/258 |

*Primary Examiner*—John J. Camby

*Attorney, Agent, or Firm*—Learman & McCulloch

[57] ABSTRACT

A shield for protecting a pyrometric cone of the kind conventionally used in the control of ceramic firing kilns comprises an annular or arcuate member open at both ends and provided with means for mounting it within the cone in a position to protect the kiln against dislodgement or other adverse consequences due to the tipping or falling of greenware within the kiln.

9 Claims, 5 Drawing Figures

SHIELD FOR PYROMETRIC CONES USED IN CERAMIC FIRING KILNS

In the firing of ceramics in an electrically heated ceramics kiln it is conventional to maintain the electrical heating circuitry operable by means of a switch mounted externally of the kiln and which is controlled by a control member which extends into the kiln. The control member maintains the switch in its circuit energized condition by means of a pyrometric cone which acts on and supports the control member. When the temperature within the kiln reaches a predetermined level for a predetermined time, as determined by the composition of the cone, the latter deforms or melts so as to remove its support from the control member, thereby enabling the latter to shift its position and permit the switch to open and render the electrical heating circuitry inoperative.

It is not uncommon for ceramic greenware in the kiln to shift its position or collapse. The shifting or collapse of the greenware in some cases causes it to lie against the cone supporting apparatus and interfere with or prevent the operation of the heating circuit control mechanism. In such an event the kiln, the greenware, or both, can be irreparably damaged.

Apparatus constructed according to the invention is adapted to overcome the problems referred to above and comprises essentially an annular member adapted to enclose and overhang the pyrometric cone so as to prevent dislodgement of the latter and jamming of the circuit control mechanism. The shield construction, however, is such as to ensure adequate exposure of the pyrometric cone to be heat of the kiln so as not to interfere with the normal operation of the latter.

Apparatus constructed in accordance with the invention is illustrated in the accompanying drawings wherein.

Figure 1:
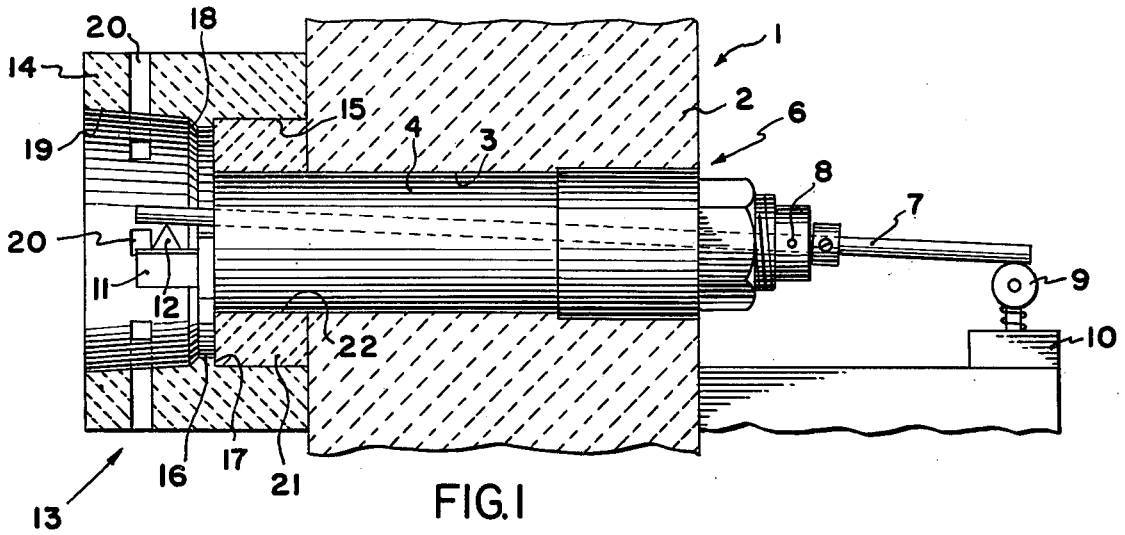
FIG. 1 is a vertical sectional view through a wall of a ceramics kiln and illustrating one embodiment of the shield construction in operative condition.

A cone shield constructed according to the invention is adapted for use with an electrically heated, ceramic kiln 1 having a refractory side wall 2 through which extends an opening 3. Fitted snugly into the opening 3 and extending into the kiln is a porcelain tube 4 having a vertically oriented opening 5 extending therethrough. The tube is free at one end and is fitted at its other end with a mounting assembly 6 in which an elongate, metallic operating rod 7 is pivoted as at 8. The rod 7 is of such length that one end thereof extends beyond the assembly 6 to overlie a spring pressed, vertically reciprocable actuator 9 forming part of an electrical switch 10 which controls electrical heating elements (not shown) of the kiln in a conventional manner. The opposite end of the rod 7 projects beyond the tube 4 so as to occupy a position within the interior of the kiln.

To that end of the tube 4 which extends into the kiln is fitted a pair of metallic supports 11 which are adapted to support a pyrometric cone 12. The height of the cone 12 is such that, in its cool state, it supports the overhanging end of the rod 7 in such position that the opposite end of the rod bears against the switch actuator 9 and maintains the switch 10 closed so as to enable electrical energy to be supplied to the kiln's heating elements. The pivotal mounting of the rod 7, however, is such that, in the absence of the cone 12, or upon melting or deformation thereof, the rod 7 will rock counterclockwise from the position shown in FIG. 1 so as to enable the switch actuator 9 to move upwardly and open the switch 10.

The apparatus thus far described is conventional and forms no part of the invention per se, aside from the manner in which it cooperates with apparatus yet to be described.

Figure 2:
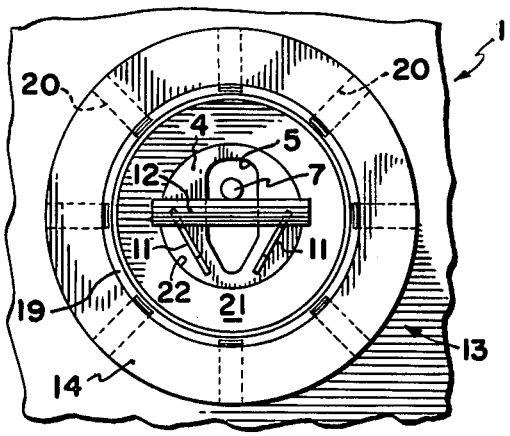
FIG. 2 is an elevational view of the apparatus as viewed from the left-hand end of FIG. 1.
Figure 3:
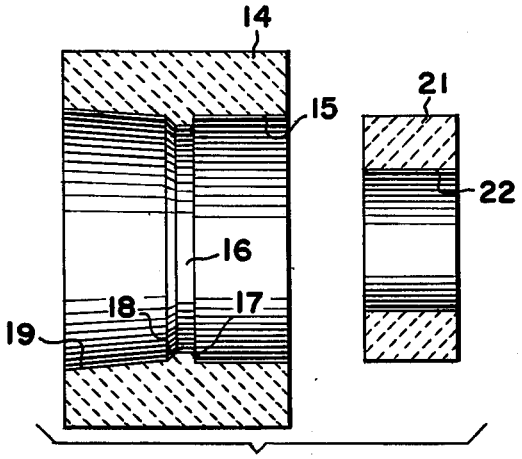
FIG. 3 is a sectional, exploded view of the shield construction.

A shield constructed in accordance with the embodiment of FIGS. 1 – 3 is designated generally by the reference character 13 and comprises an annular body 14 formed of porcelain or the like having an axial bore 15 adjacent one end thereof. The bore 15 terminates at an internal rib 16 having an abrupt surface or seat 17. The opposite surface 18 of the rib 16 is inclined and joined to an axially diverging bore 19. The wall of the member 14 preferably is provided with a plurality of circumferentially spaced, radial openings 20 which communicate with the bore 19. The inside diameter of the member 14 is substantially greater than that of the tube 4 so as to provide ample exposure of the cone 12 to the heat within the kiln.

The member 14 is mounted on the projecting end of the tube 4 by a mounting ring 21 having a bore 22 which fits snugly on the ring 4. The outer surface of the mounting ring 21 fits snugly within the bore 15 of the shield member 14, and the axial thickness of the ring 21 is such that the latter may seat snugly against the seat 17.

In the embodiment shown in FIGS. 1 – 3, the shield construction 13 comprises the two members 14 and 21. The two part construction facilitates its assembly on the tube 4 in those instances in which the length of the cone 12 is greater than the diameter of the tube 4, as it illustrated in FIG. 2. To assemble the apparatus 13 on the tube 4 when the length of the core 12 is greater than the diameter of the tube 4, the mounting ring 21 first is fitted onto the tube, the cone 12 then is placed on its supports 11, and finally the member 14 is fitted onto the mounting ring 21. In those instances in which the length of the cone 12 is less than the diameter of the tube 4, the members 14 and 21 can be combined in an integral unit.

Figure 4:
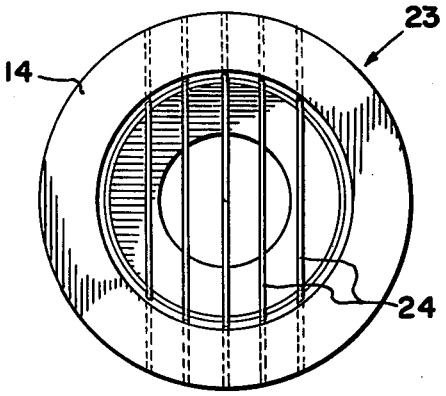
FIGS. 4 and 5 are elevational views of two other embodiments of shield construction.

FIG. 4 illustrates a shield construction 23 which corresponds to the construction 13 with the exception that a number of spaced apart wires 24 are supported in the member 14 adjacent the free end of the bore 19. The wires form a protective grid or screen for the open end of the member 14.

Figure 5:
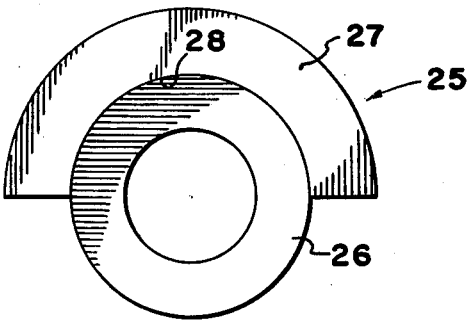

The shield construction 25 illustrated in FIG. 5 includes a mounting ring 26 like the ring 21 and an arcuate member 27 like the member 14 with the exceptions that the member 27 is semi-circular, rather than annular and the inner surface 28 of the member 27 is axial, rather than divergent.

When any of the disclosed embodiments of the shield construction is fitted onto the tube 4, the outer member 14, 27 overhangs and projects beyond the cone 12 and the operating rod 7, thereby shielding the cone and the operating rod to prevent their being engaged by tipped or fallen greenware. However, there is adequate exposure of the cone 12 to the heat within the kiln to enable the cone to act in the same manner as if the shield were not present.

The divergence of the bore 19 provides for drainage of any material which may fall onto the bore.

The disclosed embodiments are representative of presently preferred forms of the invention, but are intended to be illustrative rather than definitive thereof. The invention is defined in the claims.

We claim:

1. In a ceramic kiln into which extends one end of a hollow tube through which a swingable control member extends and projects beyond said tube into said kiln, said control member normally being maintained in a preselected position by means of a heat deformable cone member, , and means for supporting said cone member at a position adjacent but spaced axially from said one end of said tube, the improvement comprising a shield construction having a heat resistant shield member supported on said tube at said one end thereof and being of such length as to extend axially of said tube into said kiln a distance to overhang the supporting means for said cone member, said shield member having at least one opening therein in communication with said kiln.

2. The construction set forth in claim 1 wherein said shield member comprises an annulus open at its opposite ends.

3. The construction set forth in claim 1 wherein said shield member is annular and has an axially diverging bore adjacent one end thereof.

4. The construction set forth in claim 1 wherein said shield member comprises an annulus open at its opposite ends, said annulus having a diverging bore adjacent one end thereof.

5. The construction according to claim 4 wherein said shield member has an internal rib between its ends and wherein said divergent bore commences at said rib.

6. The construction according to claim 1 wherein said shield member is perforated adjacent one end thereof radially of said tube.

7. The construction according to claim 1 wherein said shield member is annular and open at its opposite ends, and including spaced apart members carried by and spanning said shield member adjacent one end thereof and forming a grid adjacent said one end.

8. The construction according to claim 1 wherein said shield member is arcuate.

9. The construction according to claim 8 wherein said shield member is substantially semicircular.

* * * * *